US006408781B1

(12) United States Patent
Daniels

(10) Patent No.: US 6,408,781 B1
(45) Date of Patent: Jun. 25, 2002

(54) MOORING SYSTEM AND METHOD FOR DEEP AND ULTRA DEEP WATER

(75) Inventor: Jim T. Daniels, Chobham Surrey (GB)

(73) Assignee: Texaco Inc., White Plains, NY (US)

( * ) Notice: Subject to any disclaimer, the term of this patent is extended or adjusted under 35 U.S.C. 154(b) by 0 days.

(21) Appl. No.: 09/162,941

(22) Filed: Sep. 29, 1998

(51) Int. Cl.[7] ..... B63B 21/50
(52) U.S. Cl. ..... 114/293; 114/230.2
(58) Field of Search ..... 114/293, 230.2, 114/264, 265; 441/3

(56) References Cited

U.S. PATENT DOCUMENTS 2,986,888 A * 6/1961 Borrmann et al.
3,703,151 A * 11/1972 Clement ..... 114/230
4,509,448 A * 4/1985 Pease et al. ..... 114/293
5,147,148 A * 9/1992 White et al. ..... 405/199
H1372 H * 11/1994 Glasscock et al. ..... 405/204
6,170,424 B1 * 1/2001 Boerseth ..... 114/293

* cited by examiner

*Primary Examiner*—Sherman Basinger
(74) *Attorney, Agent, or Firm*—Morris N. Reinisch; Howrey Simon Arnold & White

(57) ABSTRACT

A mooring system and method for mooring in deep and ultra deep water which allows conventional shallow water floating platforms and vessels to be moored in deep and ultra deep water using a conventional shallow water mooring system, while maintaining an acceptable watch circle. A plurality of buoys are placed at a specific depth below the ocean surface and are tethered at high tension to the ocean floor such that the buoys remain stationary. A shallow water floating platform or vessel can then be moored to the buoys using a conventional mooring system, being in effect "fooled" into believing that the sea bottom is shallower than it actually is.

19 Claims, 2 Drawing Sheets

MOORING SYSTEM AND METHOD FOR DEEP AND ULTRA DEEP WATER

BACKGROUND OF THE INVENTION

This invention relates to an improved system and method for mooring floating platforms, vessels, or other offshore equipment in deep and ultra deep water.

Currently, offshore oil and gas drilling and production can be done through the use of floating platforms and other vessels which are moored to the sea floor for stability. For those floating vessels working in relatively shallow water, a catenary mooring system is usually used. This system consists of a plurality of chain or wire moorings which are connected to anchors set into the sea bottom. In this mooring system, the chain or wire moorings used are not under a high degree of tension and sag under their own weight such that they do not form a straight line from the anchoring system to the floating platform or vessel. As a result, the platform is allowed a limited amount of movement, known as a "watch circle," caused by ocean currents.

At depths greater than 850 fathoms, the catenary system begins to be ineffective for drilling and production purposes. Because of the deep water, there is more slack in the mooring lines, resulting in a larger watch circle. Because it is important to limit the motion of floating platforms to within certain limits, especially in rough seas, the catenary system is not effective for use in deep and ultra deep water (greater than 2,000 feet).

In previous deep water mooring systems, buoys have been placed in the line of regular catenary mooring wires in order to keep these wires from drooping. These systems, however, were primarily used with wires or chains having less weight than those ordinarily used with conventional catenary mooring systems. The use of this system in deep water also resulted in an unacceptable watch circle during rough weather, especially in seas deeper than 2,000 feet. This resulted in a large amount of down time for the drilling or production operations due to bad weather.

Two additional mooring systems have been developed for use in deep and ultra deep water. These are the taut wire system and light wire catenary system. These systems, however, require major changes to both the floating platforms and mooring systems in order to stay within acceptable watch circle limits.

The taut wire mooring system is currently the primary mooring system used in deep and ultra deep water. This system consists of anchoring a floating platform directly to the sea floor by a plurality of mooring lines such as wires or cables. These mooring lines, however, must be under a very high degree of tension, such that they have no slack, in order to keep a floating platform within safe watch circle limits. In order to create this amount of tension in the mooring wires, a platform with an extremely high degree of buoyancy is necessary. One type of such a high buoyancy platform is described by Horton in U.S. Pat. No. 4,702,321. Normal platforms used in shallow water do not have sufficient buoyancy to be used effectively with the taut wire system.

The taut wire mooring system also cannot normally be used to moor vessels because of their limited size and buoyancy. Thus, only very large platforms can support the cable tension necessary for this type of system to be effective. This necessitates building large specialized platforms for use in deep water, resulting in higher production and drilling costs than those associated with conventional floating platforms having catenary mooring systems.

A second mooring system currently used with both platforms and vessels in deep and ultra deep water is a light wire catenary system. This system comprises the use of an ordinary catenary system with very light-weight mooring lines. These mooring lines are usually ropes made of a nelly buoyant, manmade fiber, such as KEVLAR. The ropes are then anchored to the sea bed as a regular catenary system. This system, however, allows a much greater watch circle than a taut wire system would in the same depth of water, resulting in a more unstable platform and increased down time in deeper water and in rough seas.

The size of the mooring ropes can also create additional problems. The mooring ropes necessary for use in this system are very bulky (approximately six inches in diameter). Because a vessel to be moored in deep water requires a very large amount of this rope, and because the rope is very bulky, most vessels do not have enough space to store the necessary amount of rope. Thus, such vessels need to be either modified and/or specially designed. Additionally, rope of this size is often too large for the winstrom used on ordinary vessels. Thus, this equipment needs to be specially designed as well.

Therefore, there is a need for a mooring system and method for use in deep and ultra deep water which does not require special equipment such as very large, ultra buoyant platforms, specially designed ropes, or special equipment to store and release these ropes. There is also a need for a deep water mooring system that can accommodate an unmodified shallow water platform or vessel. A mooring system is also needed that can use a conventional floating platform's preexisting catenary mooring system in deep and ultra deep water while maintaining an acceptable watch circle.

SUMMARY OF THE INVENTION

The present invention is directed to an improved mooring system and method for deep and ultra deep water. This invention satisfies the needs described above by allowing shallow water vessels and platforms to be moored in deep and ultra deep water without requiring any modification to their conventional catenary mooring systems. This system also allows conventional floating platforms to be moored in deep and ultra deep water while maintaining an acceptable watch circle. This method works by, in effect, "fooling" the platform into thing that it is in shallow water, or by "raising" the sea floor to a shallower level.

A version of this invention is comprised of a plurality of submerged buoys which are anchored to the sea bed by mooring lines at very high tension such that the buoys remain substantially stationary. Each buoy contains an anchoring means such as a hook, ring, or other means used to moor vessels, such that a shallow water floating platform can be anchored to these buoys by a regular catenary system. In this way, the buoys "become" the sea floor and the platform is fooled into thinking that it is in shallow water.

This system requires a plurality of submerged buoys (at least three) which are tethered at very high tension to the sea floor. The buoys are fixed at a substantially stable position at a predetermined depth by at least three mooring lines per buoy which are anchored to the sea floor. The more mooring lines between a buoy and the sea floor, the more stable that the buoy will remain. Also, the buoys' depth should be determined by the normal working depth of the floating platform. Thus, if the maximum operating depth of a floating platform is 200 feet of water, the buoys should be placed at some depth less than 200 feet below the surface.

The number of buoys used will also affect the stability of the floating platform. At least three buoys must be used. However, the more buoys used, the smaller the watch circle of the floating platform will be.

By using this method, it is not necessary to utilize a specially designed floating platform or vessel in order to moor in ultra deep water. By "raising the sea bed," normal shallow water platforms can be moored and operated in deep and ultra deep water with no modifications, and while maintaining an acceptable watch circle.

These and other features of the present invention will be readily apparent from the following Description of the Drawings in which a preferred embodiment of the invention is shown.

DETAILED DESCRIPTION OF ILLUSTRATIVE EMBODIMENTS

Figure 1:
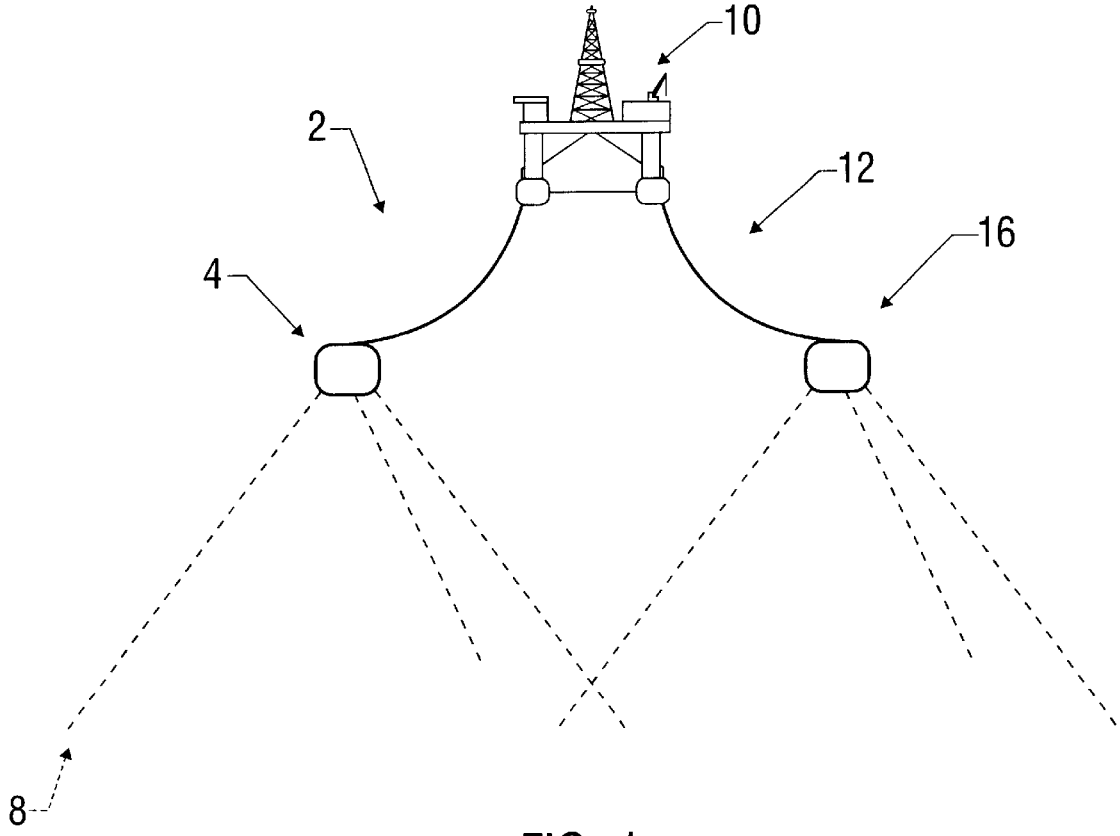
FIG. 1 is a side view of an embodiment of the improved mooring system.

In FIG. 1, an embodiment of an improved system for mooring in deep and ultra deep water 2 is disclosed. This system comprises a plurality of buoys 4 which are mounted under the water's surface at some depth. The buoys are mounted by a plurality of mooring lines 6 which are connected to conventional sea bed anchors 8 embedded in the ocean floor. These anchors 8 can be pile-driven or attached using any conventional means of attaching sea bed anchors. A floating platform or vessel 10, such as a semi-submersible drilling rig, drilling ship, or production platform, is then moored to the plurality of buoys by a conventional catenary mooring system 12. The floating platform's mooring system 12 is thus "fooled" into believing that the sea floor is at the level of the buoys 4, and hence, no special equipment is necessary for mooring in deep water.

Figure 2:
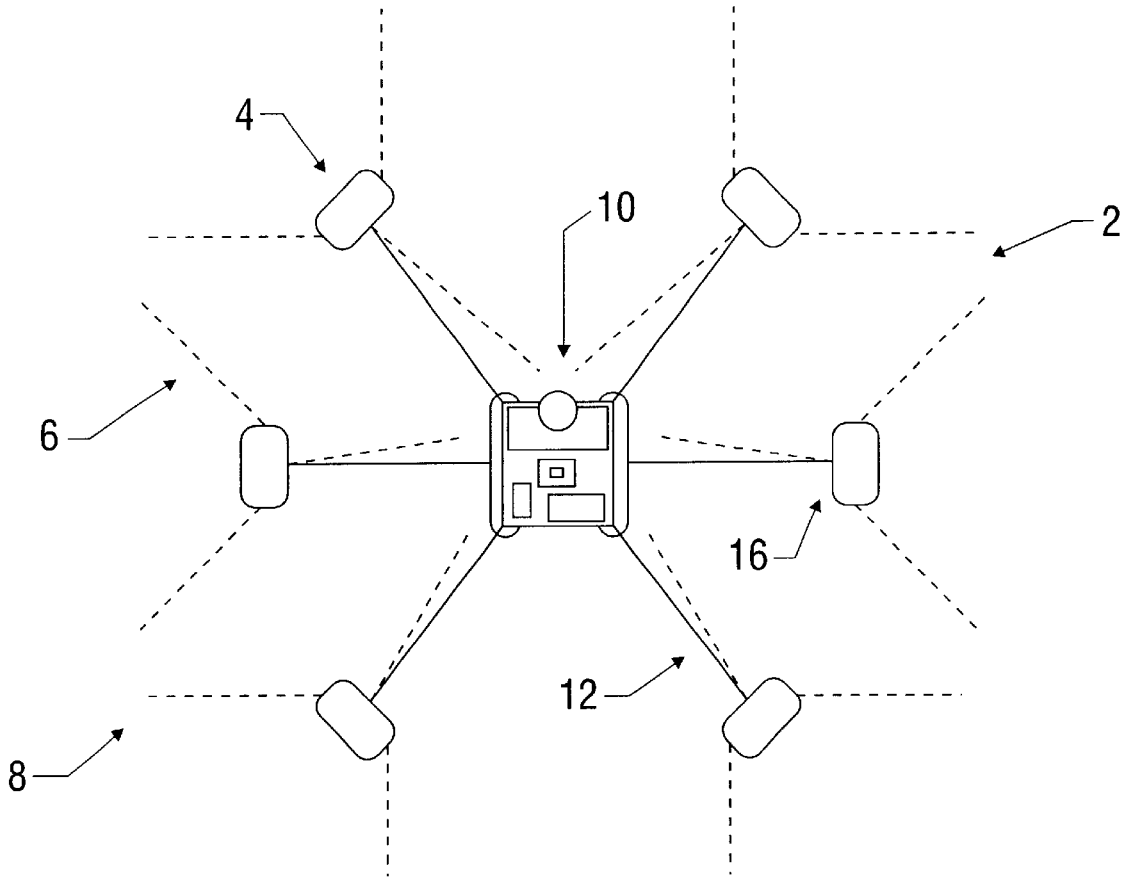
FIG. 2 is a top view of an embodiment of the improved mooring system.

As seen in FIGS. 1 and 2, the submerged buoys 4 are preferably mounted in a specific configuration some predetermined depth under the water's surface. This depth should approximate the normal working depth of the vessel to be moored. Thus, if a floating platform 10, normally used in seas up to 500 feet deep is to be moored using this system, the buoys 4 can be placed at some depth of less than 500 feet.

The buoys 4 are kept substantially stationary by high tension connecting lines 6 which are anchored to the sea bed. As seen in FIG. 2, in order to place these buoys at the required depth, a plurality of sea bed anchors 8 are set in a position on the sea floor, preferably such that the horizontal angles and distances between them are equal. The only requirement is that three or more such anchors 8 and connecting lines 6 must be used for each buoy 4. Depending on the size of the buoy 4 or the platform 10 to be moored, an additional amount of anchors 8 and connecting lines 6 can be used in order to increase the buoy's stability.

Connecting lines 6 are attached to each sea anchor 8 and fastened to a buoy 4. Preferably, these connecting lines 6 will be a cable or wire made of KEVLAR or steel sufficient to maintain the buoy's. position. Additionally, sea bed anchors 8 are preferably positioned such that when the buoy is in place, the connecting lines 6 go up to the buoy 4 at a 45° angle. However, a decrease of this angle, as a result of placing the anchors 8 further apart, will increase the stability of the buoy 4.

After the connecting lines 6 are attached to the sea bed anchors 8, each buoy 4 is submerged and brought into position. This can be done by a submersible vehicle or by winching the buoy 4 into place. The resulting system 2, as seen in FIG. 1, will have the buoys 4 set at a predetermined depth and connected to the sea floor by a plurality of lines 6 which are at a very high tension. This results in each buoy 4 remaining substantially stationary in its position under the water's surface.

Buoys 4 can be any shape or size having a buoyancy sufficient to support tension in the connecting lines 6 such that the buoys remain in a substantially stationary position. Buoys 4, however, are preferably cylindrical in shape, and preferably 15 feet long by 6 feet in diameter, in order to support a floating platform of average size. If the size of floating platform 10 increases, the system is used in deeper water, or only three buoys are in place, the size of buoys 4 may need to be increased in order to reduce movement of the floating platform 10. The buoys' size may also be increased due to a low amount of tension in the connecting lines or if very heavy connecting lines are used.

The number of buoys 4 is also important to the stability of the floating platform 10. In order for this system to be effective at least three submerged buoys, and preferably four to six, should be used to support a floating platform 10. As with connecting lines 6, the more buoys used, the more stationary the floating platform 10 will remain. Also, as with connecting wires 6, the buoys should be configured so that their relative horizontal angles and distances are equal. This is demonstrated in FIG. 2. If a very large or less buoyant platform is to be moored using this system, more than six buoys will preferably be used. However, there is no upper limit on the amount of buoys that can be used with this system.

Floating platform 10 is preferably moored to buoys 4 using a regular catenary mooring system. The platform's mooring chains 12 are lowered to the buoys, as they would to sea bed anchors, and are attached to the buoys using anchors 16 mounted on each buoy. Anchors 16 can be hooks, rings, or any other generally known way of attaching mooring lines. Any other shallow water mooring system should also be able to be adapted for use with this embodiment of the invention.

The current invention has several advantages over current mooring systems for use in deep and ultra deep water. First, it allows companies to utilize conventional platforms and vessels in deep and ultra deep water without requiring any modification of their structures or mooring systems. This significantly reduces the cost of drilling or production in deep water because of reduced research, development, manufacturing, and operating costs associated with using large, specialized, high buoyancy platforms. In addition, a floating platform can be moored in deep water with its preexisting mooring system while remaining within acceptable watch circle limits.

It will be understood that various modifications and changes may be made in the mooring system described above, and also changes in modifications coming within the spirit of the present invention and the scope of the claims appended hereto are embraced thereby.

What is claimed is:

1. A mooring system for use in deep and ultra deep water comprising:

three or more buoys located at a substantially equal depths below the surface of a body of water, each of said buoys being anchored to the sea floor by three or more connecting lines per buoy, said connecting lines having a sufficient tension such that said buoys remain in a substantially stationary position; and a means for a attaching a mooring line to each said buoy such that a floating apparatus can be moored to said buoys.

2. A method for mooring in deep and ultra deep water comprising:

placing three or more buoys at a substantially equal depth below the surface of a body of water;

anchoring said buoys to the sea floor by three or more connecting lines per buoy, said connecting lines having a sufficient tension such that said buoys remain in a substantially stationary position; and mooring a floating apparatus to said buoys.

3. A mooring system for mooring a floating apparatus in deep and ultra deep water comprising:

three or more buoys located at a depth under the surface of a body of water;

a means of keeping said buoys in a substantially stationary position even when the buoys are not moored to said floating apparatus; and a means for receiving mooring lines on said buoys.

4. The system of claim 3, said buoys being located at a substantially equal vertical depth.

5. The system of claim 3, said buoys being located at substantially equal horizontal distances and angles from each other.

6. The mooring system of claim 3, said means of keeping said buoys in a substantially stationary position comprising three or more connecting lines for each buoy, said lines having one end connected to said buoy and the other end connected to the sea floor, said connecting lines having a sufficient tension such that each said buoy remains in a substantially stationary position.

7. A method for mooring a floating apparatus in deep and ultra deep water comprising:

placing three or more buoys at a depth under the surface of a body of water such that said buoys remain in a substantially stationary position even when the buoys are not moored to said floating apparatus; and mooring a floating apparatus to said buoys.

8. The method of claim 7, in which said depth is less than the maximum working depth of the floating apparatus to be moored.

9. The method of claim 7, in which the means for keeping said buoys in a substantially stationary position comprises a plurality of high tension connecting lines attaching each of said buoys to the ocean floor.

10. The method of claim 9, said plurality of connecting lines comprising three or more connecting lines.

11. The method of claim 7, said plurality of buoys being located at a substantially equal vertical depth.

12. The method of claim 7, said buoys being placed at substantially equal horizontal distances and angles from each other.

13. A mooring system for use in deep and ultra deep water comprising:

three or more buoys located at a depth under the surface of a body of water, said buoys being held in a substantially stationary position by three or more connecting lines per buoy, each said connecting line being attached on one end to said buoy and on the other end to the sea floor.

14. The mooring system of claim 13, said connecting lines having a sufficient tension such that each said buoy remains in a substantially stationary position.

15. The mooring system of claim 13, said buoys being located at a substantially equal vertical depth.

16. The mooring system of claim 13, said buoys being located at substantially equal horizontal distances and angles from each other.

17. A mooring system for mooring a floating apparatus in deep and ultra deep water comprising:

three or more buoys located at a depth under the surface of a body of water;

a means of keeping said buoys in a substantially stationary position by a plurality of connecting lines per buoy even when the buoys are not moored to said floating apparatus; and a means for receiving mooring lines on said buoys.

18. The mooring system of claim 17, said buoys being located at a substantially equal vertical depth.

19. The mooring system of claim 17, said means of keeping said buoys in a substantially stationary position comprising three or more connecting lines for each buoy, said lines having one end connected to said buoy and the other end connected to the sea floor, said connecting lines having a sufficient tension such that each said buoy remains in a substantially stationary position.

* * * * *